US009554663B2

(12) United States Patent
Truog et al.

(10) Patent No.: US 9,554,663 B2
(45) **Date of Patent: *Jan. 31, 2017**

(54) EATING UTENSIL ASSEMBLY AND RELATED METHODS

(71) Applicant: SNAP CO, INC, Lake Mary, FL (US)

(72) Inventors: Kimberly Truog, Lake Mary, FL (US); Corbet Truog, Lake Mary, FL (US)

(73) Assignee: Snap Out Solutions, LLC, Lake Mary, FL (US)

( * ) Notice: Subject to any disclaimer, the term of this patent is extended or adjusted under 35 U.S.C. 154(b) by 3 days.

This patent is subject to a terminal disclaimer.

(21) Appl. No.: 14/096,425

(22) Filed: Dec. 4, 2013

(65) Prior Publication Data

US 2015/0150396 A1 Jun. 4, 2015

(51) Int. Cl.

| | |
|---|---|
| ***A47G 21/06*** | (2006.01) |
| ***A47G 21/04*** | (2006.01) |
| ***A47G 21/02*** | (2006.01) |
| ***B25F 1/00*** | (2006.01) |
| ***B25G 1/10*** | (2006.01) |

(52) U.S. Cl.

CPC ..... *A47G 21/06* (2013.01); *A47G 21/02* (2013.01); *A47G 21/04* (2013.01); *B25F 1/00* (2013.01); *B25G 1/102* (2013.01); *Y10T 29/49* (2015.01)

(58) Field of Classification Search

CPC ..... A47G 21/02; A47G 21/023; A47G 21/06; A47G 21/08; B21D 53/62

USPC ..... 30/148, 149; 76/105, 104.1

See application file for complete search history.

(56) References Cited

U.S. PATENT DOCUMENTS

| | | | | |
|---|---|---|---|---|
| 33,285 A | | 9/1861 | Ames | |
| 34,069 A | | 1/1862 | Neill | |
| 62,640 A | * | 3/1867 | Lamson | A47G 21/02 30/322 |
| 147,119 A | | 2/1874 | Francis | |
| 9,687 A | | 5/1881 | Cox | |
| 398,264 A | * | 2/1889 | Kisner | A47G 21/06 30/150 |
| 904,553 A | | 11/1908 | McCoy | |
| 1,490,785 A | * | 4/1924 | Purnell | A47G 21/181 30/141 |

(Continued)

FOREIGN PATENT DOCUMENTS

| | | |
|---|---|---|
| CN | 201551071 U | 8/2010 |
| CN | 202504912 U | 10/2012 |

(Continued)

OTHER PUBLICATIONS

English Translation of CN 201551071 U.*

(Continued)

*Primary Examiner* — Jennifer Swinney

(74) *Attorney, Agent, or Firm* — Allen, Dyer, Doppelt, Milbrath & Gilchrist, P.A.

(57) ABSTRACT

An eating utensil assembly may include a first eating utensil that may include a first handle having an opening therein and an eating utensil head coupled to an end of the first handle and having a curved shape. The eating utensil assembly may also include a second eating utensil removably carried by the first eating utensil within the opening in the first handle. The second eating utensil may include a second handle and a cutting blade coupled to an end of the second handle.

14 Claims, 7 Drawing Sheets

(56) References Cited

U.S. PATENT DOCUMENTS

| | | | | | |
|---|---|---|---|---|---|
| 1,606,039 | A | * | 11/1926 | Norman | A47G 21/181 30/141 |
| 1,607,864 | A | * | 11/1926 | Butler | A47G 19/06 220/574 |
| 2,185,942 | A | | 1/1940 | Frank | |
| 2,545,121 | A | * | 3/1951 | Szopa | 30/142 |
| 2,877,547 | A | * | 3/1959 | Feaster | 30/1 |
| 3,136,416 | A | * | 6/1964 | Goldrosen | B65D 73/0021 206/372 |
| 3,252,489 | A | * | 5/1966 | Huston et al. | 30/308.1 |
| 3,664,020 | A | * | 5/1972 | Hammond et al. | 30/142 |
| 3,783,883 | A | * | 1/1974 | Alexander | A61C 15/046 132/323 |
| 4,030,194 | A | * | 6/1977 | Hendricks | 30/143 |
| 4,922,611 | A | | 5/1990 | Levy | |
| 5,701,675 | A | * | 12/1997 | Hall et al. | 30/123 |
| 6,003,710 | A | * | 12/1999 | Huang | B65D 51/246 215/228 |
| 6,371,324 | B1 | * | 4/2002 | Torniainen | B65D 51/246 206/541 |
| D610,747 | S | * | 2/2010 | Brownell | D28/65 |
| D665,630 | S | | 8/2012 | Vasavada | |
| 2007/0033809 | A1 | | 2/2007 | Shirazi | |
| 2011/0035946 | A1 | | 2/2011 | Menceles | |
| 2011/0146082 | A1 | * | 6/2011 | Hassanpour et al. | 30/147 |
| 2012/0103356 | A1 | * | 5/2012 | Crisp | 132/200 |
| 2012/0222311 | A1 | * | 9/2012 | Wang | A47G 21/12 30/123 |
| 2013/0232793 | A1 | | 9/2013 | Fazal | |

FOREIGN PATENT DOCUMENTS

| | | | | | |
|---|---|---|---|---|---|
| CN | 202959903 | U | | 6/2013 | |
| CN | 203106623 | U | | 8/2013 | |
| CN | 103385638 | A | | 11/2013 | |
| DE | 29710423 | U1 | * | 8/1997 | A47G 21/02 |
| DE | 102009030050 | A1 | * | 3/2011 | A47G 21/02 |
| EP | 0257109 | A1 | | 3/1988 | |
| JP | 2006296868 | A | | 11/2006 | |
| WO | 2011139353 | A1 | | 11/2011 | |

OTHER PUBLICATIONS

English Translation of CN 203106623 U.*
Truog et al., Design U.S. Appl. No. 29/482,932, filed Feb. 24, 2014.
Truog et al., Design U.S. Appl. No. 29/482,940, filed Feb. 24, 2014.

* cited by examiner

EATING UTENSIL ASSEMBLY AND RELATED METHODS

TECHNICAL FIELD

The present application is directed to utensils, and more particularly, to eating utensils and related methods.

BACKGROUND

An eating utensil is a common tool for cutting and eating food. For example, an eating utensil, which may be considered a form of cutlery, may include a fork, knife, or spoon. A fork, for example, typically includes a handle and tines extending outwardly from the handle. A spoon typically includes a handles and a relatively small oval or round bowl coupled to an end of the handle. A knife also typically includes a handle and a cutting blade at an end of the handle.

Traditionally, the knife, fork, and spoon are separate utensils. In other words, for each eating function, there is typically a corresponding utensil. Over time, the shape and size of an eating utensil has changed, for example, based upon a type of use (e.g., single or multi-use), type of food, etc.

One such change to the shape or size of a typical eating utensil has been to combine eating utensils so that a single eating utensil has both the shape and function of what has been traditionally a single eating utensil. For example, a spork is a combination spoon and fork, a sporf is a combination spoon, fork, and knife, a splayd is a combination spoon, fork, and knife, and a spife is a combination spoon and knife.

SUMMARY

An eating utensil assembly may include a first eating utensil that may include a first handle having an opening therein, and an eating utensil head coupled to an end of the first handle and having a curved shape. The eating utensil assembly may further include a second eating utensil removably carried by the first eating utensil within the opening in the first handle. The second eating utensil may include a second handle, and a cutting blade coupled to an end of the second handle. Accordingly, the eating utensil assembly may provide increased user convenience and eating efficiency. For example, the eating utensil assembly may be used instead of a separately packaged knife and fork, and this may also reduce waste.

The opening may include a through-opening, for example. The opening may include a blind opening.

The eating utensil assembly may also include at least one coupling body within the opening to couple the second eating utensil to the first eating utensil within the opening. The eating utensil assembly may further include a plurality of breakaway tabs removably coupling the second eating utensil to the first eating utensil within the opening. The plurality of breakaway tabs may be between the second eating utensil and the first utensil along a perimeter of the opening. The eating utensil assembly may include a retaining protrusion coupled to the first handle and extending within the opening, and configured to retain the second utensil within the opening, for example.

The eating utensil head may include at least one of a plurality of tines extending outwardly from an end of the first handle and a rounded container coupled to the end of the first handle. The second eating utensil may be removably carried within the opening flush with an upper surface of the first handle, for example.

The opening and the second utensil may have a same shape. The first and second eating utensils may be aligned along a length of each of the first and second eating utensils, for example.

A method aspect is directed to method of making an eating utensil assembly. The method may include forming a first eating utensil that includes a first handle having an opening therein, and an eating utensil head coupled to an end of the first handle and having a curved shape. The method may also include forming a second eating utensil to be removably carried by the first eating utensil within the opening in the first handle, and that includes a second handle and a cutting blade coupled to an end of the second handle.

DETAILED DESCRIPTION

Figure 1:
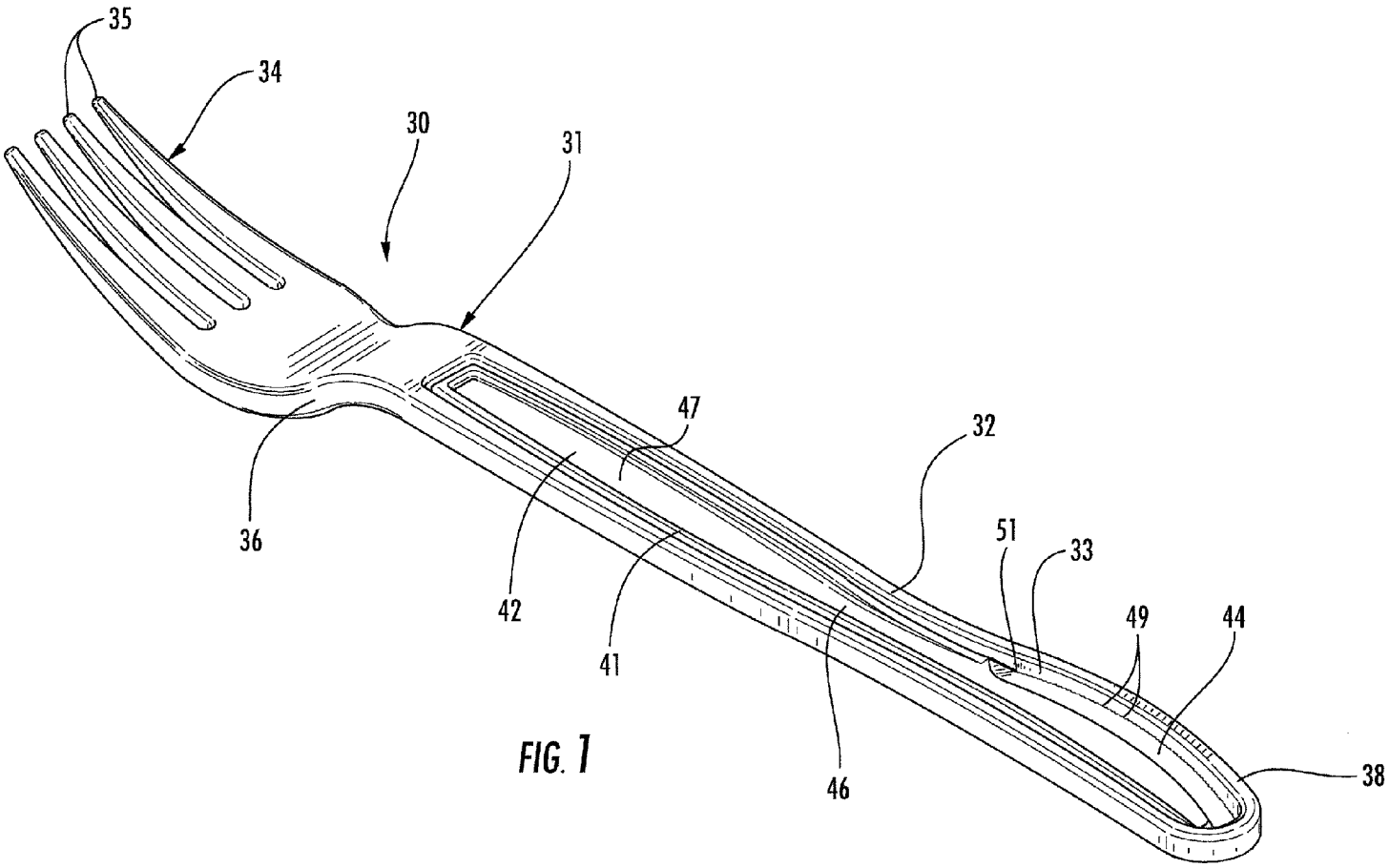
FIG. 1 is an enlarged perspective view of an eating utensil assembly according to an embodiment.
Figure 2:
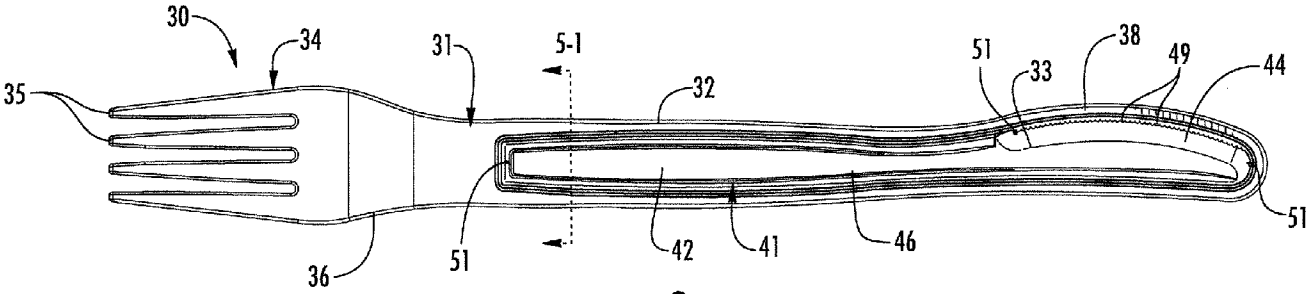
FIG. 2 is a top view of the eating utensil assembly of FIG. 1.
Figure 3:
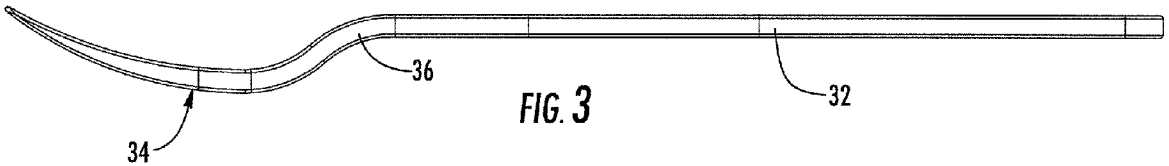
FIG. 3 is a side view of the eating utensil assembly of FIG. 1.
Figure 4:
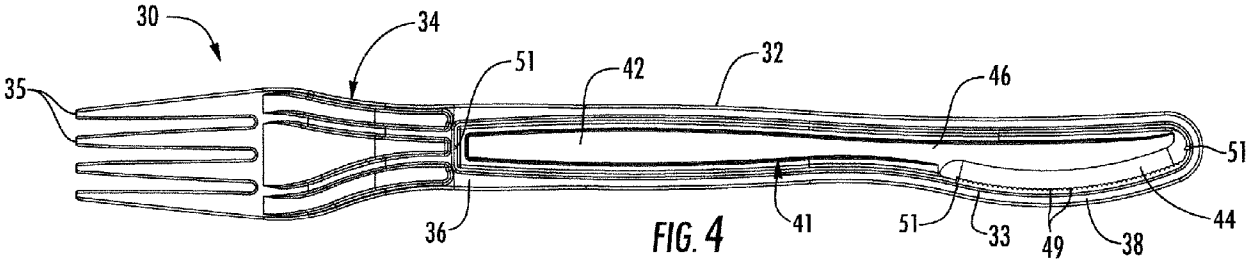
FIG. 4 is a bottom view of the eating utensil assembly of FIG. 1.
Figure 5:
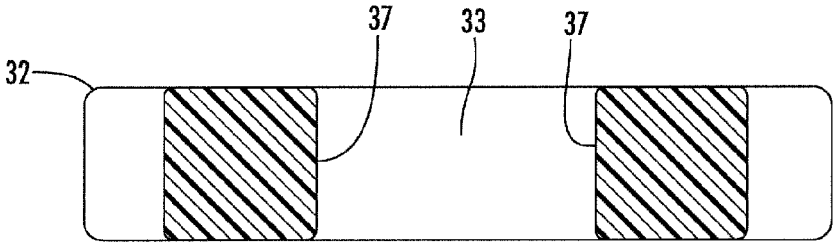
FIG. 5 is an enlarged cross-sectional view of a portion of the eating utensil assembly taken along line 5-1 of the eating utensil assembly of FIG. 2.
Figure 6:
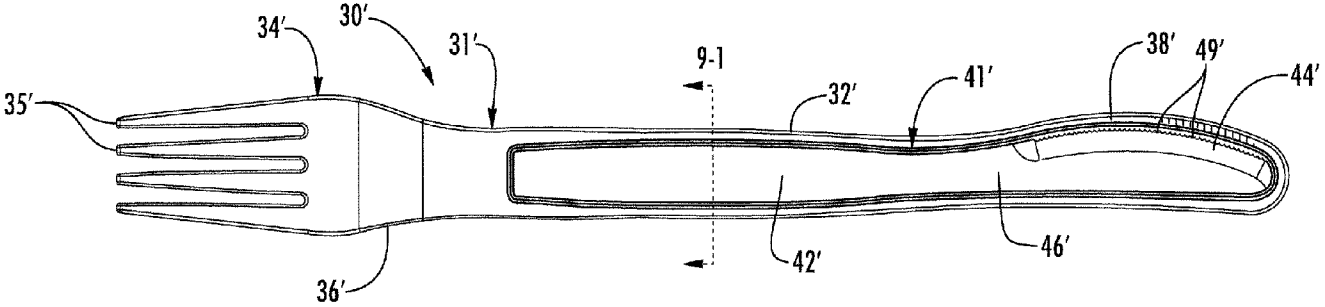
FIG. 6 is a top view of the eating utensil assembly according to another embodiment.
Figure 7:
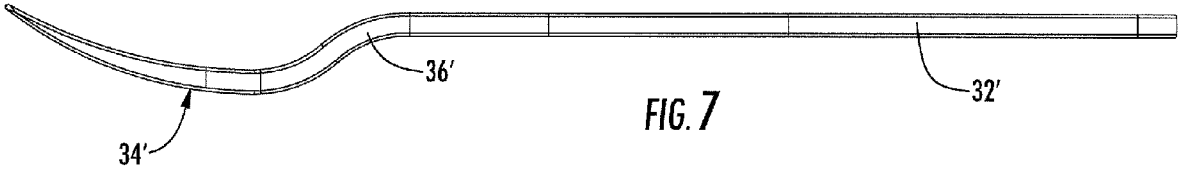
FIG. 7 is a side view of the eating utensil assembly of FIG. 6.
Figure 8:
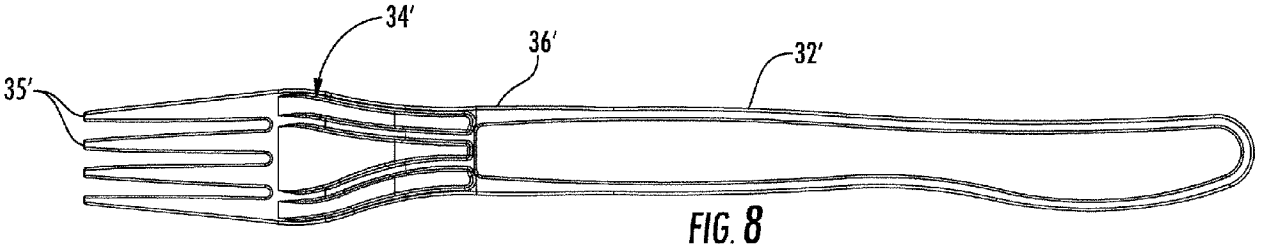
FIG. 8 is a bottom view of the eating utensil assembly of FIG. 6.
Figure 9:
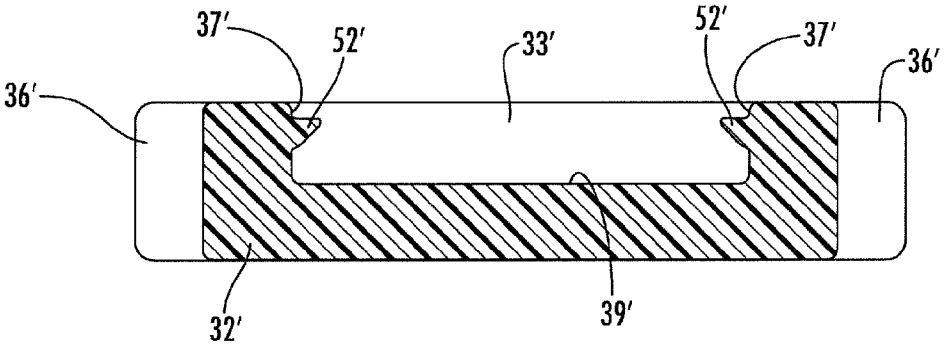
FIG. 9 is an enlarged cross-sectional view of a portion of the first eating utensil taken along line 9-1 of the eating utensil assembly of FIG. 6.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime and multiple prime notation is used to refer to like elements in different embodiments.

Referring initially to FIGS. 1-5, an eating utensil assembly 30 includes a first eating utensil 31 that is illustratively in the form of a fork. The first eating utensil 31 includes a first handle 32 having an opening 33 therein. The first handle 32 is illustratively planar in shape and also has an elongate shape.

A curved eating utensil head illustratively in the form of a fork head 34 is coupled to an end 36 of the first handle 32. In particular, the fork head 34 includes tines 35 that extend outwardly from the end 36 of the first handle.

The opening 33 in the first handle 32 is a through-opening. In other words, the opening 33 extends through the first handle 32. The opening 33 defines sidewalls 37. Exemplary dimensions of the first eating utensil 31 may be 8 inches long by about 1 inch wide by about 0.6 inches high, with the first handle 32 having dimensions of about 6 inches by 0.18 inches by 0.9 inches. Of course, the first eating utensil 31, including the first handle 32, may be other dimensions.

The eating utensil assembly 30 also includes a second eating utensil 41 removably carried by the first eating utensil 31, and more particularly, within the opening 33 in the first handle 32. The second eating utensil 41 is illustratively in the form of a knife and includes a second handle 42 and a cutting blade 44 that includes serrations 49 coupled to an end 46 of the second handle. The second eating utensil is carried within the opening 33 aligned lengthwise with the first handle 31. In other words, both the first and second eating utensils 31, 41 are aligned lengthwise.

Coupling bodies, for example, in the form of breakaway tabs 51 are in the opening and coupled the first eating utensil 31 to the second eating utensil within the opening 33. More particularly, the opening 33 and the second eating utensil 41 have a same shape (i.e., knife shape), with the opening sized slightly larger than the second eating utensil to receive the second eating utensil therein. The first handle 32 may have an enlarged width portion 38 opposite the fork head 34 to accommodate an opening and thus the second eating utensil 41. Of course, the first handle 32 may have other or additional shapes to accommodate different sized and shaped second eating utensils 41, for example, knives.

The breakaway tabs 51 are spaced apart, along the perimeter of the opening 33 and between the sidewalls 37 and the second eating utensil 41. The breakaway tabs 51 conceptually maintain the second eating utensil 41 suspended within the opening 33. The breakaway tabs 51 may be sized, for example, to space the second eating utensil 41 from the first eating utensil 31 by about 0.02 inches or less. In other words, the breakaway tabs 51 may be 0.02 inches or less in size. Of course, the breakaway tabs 51 may be other dimensions, and each of the tabs need not be the same size.

The second eating utensil 41 is removably carried within the opening 33 flush with an upper surface 47 of the first handle 32. The second eating utensil 41 may also be removably carried within the opening 33 flush with a lower surface 48 of the first handle 32. In other words, the second eating utensil 41, when carried within the opening 33, may not protrude from the opening. This may allow more comfortable use and/or gripping when using only the fork or first eating utensil 31 without removing the second eating utensil 41, and which may give the appearance of a single or monolithic eating utensil.

The breakaway tabs 51, and the first and second eating utensils 31, 41 may be formed of plastic, for example, similar to that of disposable cutlery or utensils, as will be appreciated by those skilled in the art. However, the breakaway tabs 51, and the first and second eating utensils 31, 41 may be another material, for example, and may include metal.

In operation, a user desirous of using the second eating utensil 41, or knife, may "snap" the second eating utensil out from within the opening 33. A downward or upward force on the second eating utensil 41 relative to the first handle 32 causes the second eating utensil to separate from the breakaway tabs 51. The breakaway tabs 51 may additionally or alternatively separate from the sidewalls 37 in the opening 33 allowing the second eating utensil 41 to be used independently of the first eating utensil 31.

As will be appreciated by those skilled in the art, in addition to increased convenience, for example, the eating utensil assembly 30 described herein may be particularly advantageous for reducing disposable eating utensil waste. In particular, the amount of material for the eating utensil assembly 30 yields two eating utensils. Additionally, since two or even three utensils are formed in a single utensil body, for example, a user would use a single eating utensil assembly reducing packaging and space, for example, for shipping and counter space at a restaurant. In other words, instead of using a separate utensil or a separate fork, knife, and/or spoon, a single eating utensil assembly 30 described herein may be used, reducing waste by as much as three-times, which also corresponds to reduced cost.

Referring now to FIGS. 6-10, in another embodiment, the opening 33' in the first handle 31' is a blind opening. In other words, the opening 33' does not extend all the way through the first handle 31'. The opening 33' defines sidewalls 37' and a floor or base 39'. The second eating utensil 41' is carried within the opening 33', and more particularly, carried by the base 39'.

A retaining protrusion 52' is coupled to the first handle and extending within the opening 33'. The retaining protrusion 52' may have a sloped or triangular shape (FIG. 9) for retaining the second utensil 41' within the opening 33'. Of course, the retaining protrusion 52' may have a different or other shape or shapes.

The retaining protrusion 52' extends within the opening 33' along a perimeter thereof. The retaining protrusion 52' does not extend adjacent the cutting blade 44'. In some embodiments, the retaining protrusion 52' may be continuous around the perimeter of the opening, or there may be multiple retaining protrusions, which may be spaced apart.

Figure 10:
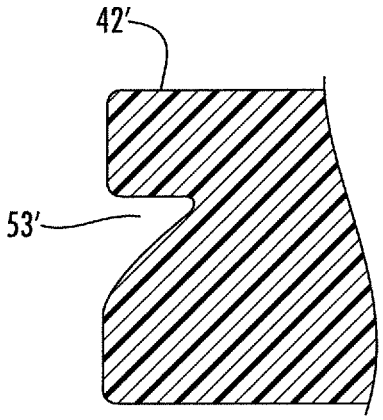
FIG. 10 is an enlarged cross-sectional view of a portion of the second eating utensil taken along line 9-1 of the eating utensil assembly of FIG. 6.

The second handle 42' has a recess 53' therein for receiving the retaining protrusion 52' (FIG. 10). The retaining protrusion 52' and the recess 53' cooperate so that the second eating utensil 41' is retained or coupled within the opening 33'. Conceptually, the second eating utensil 41' is "snapped" within the recess 33'.

In operation, and where the eating utensil assembly 30' is plastic or other pliable material, removal of the second eating utensil 41' may be accomplished by applying downward pressure to the ends 36', 56' of the first eating utensil, or more particularly, the first handle 32', which causes the second eating utensil to "snap" out of the opening 33'. In other embodiments, for example, where the eating utensil assembly 30' is metal or other more rigid material, a cut-out or tab may be in the second handle 42' to allow a user's finger, for example, to pry between the base 39' and the second handle. Of course, other or additional retaining and removal techniques may be used as will be appreciated by those skilled in the art.

It should be understood that while breakaway tabs 51 and a through-opening 33 have been described with the embodiment illustrated with respect to FIGS. 1-5, and a retaining protrusion 52' and a blind opening 33' have been described with respect to the embodiment in FIGS. 6-10, in some embodiments, the breakaway tabs may be used with the blind opening. Similarly, in other embodiments, the retaining protrusion 52' may be used with the through-opening 33.

Figure 11:
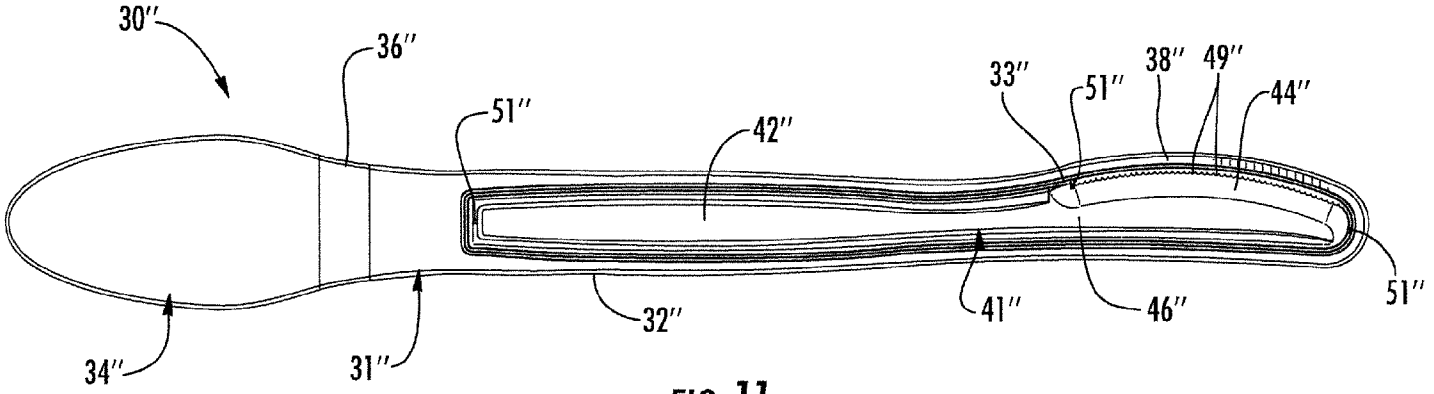
FIG. 11 is a top view of an eating utensil assembly in accordance with another embodiment.
Figure 12:
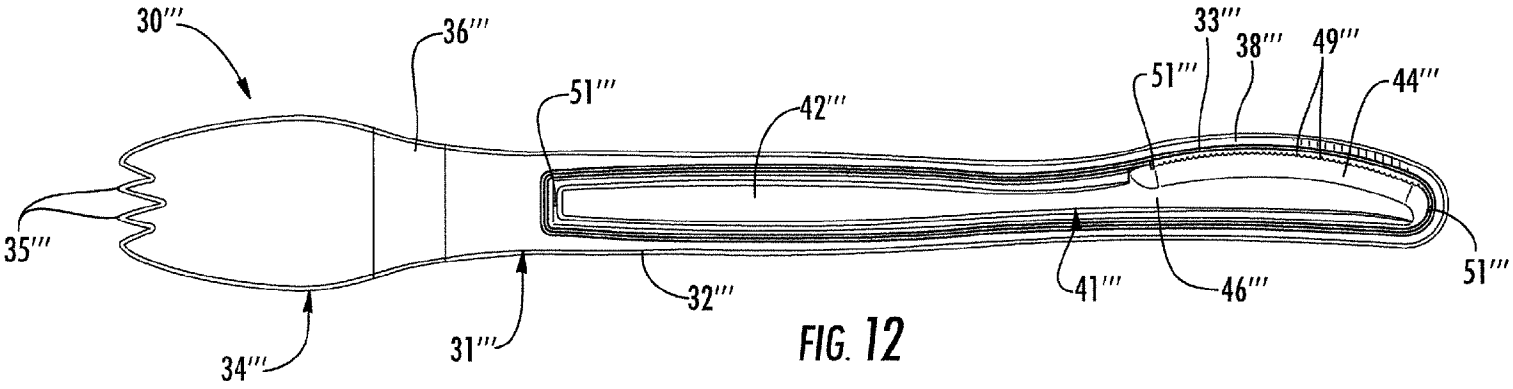
FIG. 12 is a top view of an eating utensil assembly in accordance with yet another embodiment.

Referring now to FIGS. 11 and 12, in other embodiments, the first eating utensil 31" may be in the form of a spoon and the curved eating utensil head may be a curved or rounded food container 34" coupled to the end 36" of the first handle 32" (FIG. 11). In yet another embodiment, the first eating utensil 31''' may be in the form of a spork and the curved eating utensil head may be a curved or rounded food container 34''' with tines 35''' extending from the curved food container. (FIG. 12). Other elements of the eating utensil assemblies 30" and 30''' illustrated are similar to those previously described with respect to FIGS. 1-5.

A method aspect is directed to a method of making an eating utensil assembly 30. The method includes forming a first eating utensil 31 that includes a first handle 32 having an opening 33 therein and an eating utensil head 34 coupled to an end 36 of the first handle and having a curved shape. The method includes forming a second eating utensil 41 to be removably carried by the first eating utensil 31 within the opening 33 in the first handle 32, and including a second handle 42 and a cutting blade 44 coupled to an end 46 of the second handle 42.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. An eating utensil assembly comprising:

a first eating utensil comprising a first handle having a through-opening therein, said first handle and the through-opening each having a proximal end and enlarged width distal end that is enlarged relative to the proximal end to define a first handle contour and a through-opening contour, respectively, the first handle contour matching the through-opening contour, and a first eating utensil head coupled to the proximal end of said first handle;

a second eating utensil removably carried by said first eating utensil within the through-opening in said first handle and extending a length of said first handle from the proximal end of the through-opening to the enlarged width distal end of the through-opening, said second eating utensil having a proximal end and an enlarged width distal end that is enlarged relative to the proximal end of said second eating utensil to define a second eating utensil contour, the second eating utensil contour matching the first handle and through-opening contours, said second eating utensil and comprising a second handle carried within the proximal end of the through-opening, and a second eating utensil head carried within the enlarged distal end of the through-opening and coupled to said second handle and having an elongated cutting edge; and a plurality of breakaway tabs removably coupling said second eating utensil to said first eating utensil so that said second eating utensil is suspended within the through-opening;

said plurality of breakaway tabs, said first eating utensil, and said second eating utensil defining a monolithic unit.

2. The eating utensil assembly of claim 1, wherein said plurality of breakaway tabs are spaced apart between said second eating utensil and said first eating utensil along a perimeter of the through-opening.

3. The eating utensil assembly of claim 1, wherein said second eating utensil is removably carried within the through-opening flush with an upper surface of said first handle.

4. The eating utensil assembly of claim 1, wherein said plurality of breakaway tabs extend inwardly from said first handle within the through-opening.

5. The eating utensil assembly of claim 1, wherein said first eating utensil head has a curved shape.

6. The eating utensil assembly of claim 1 wherein said elongated cutting edge comprises a plurality of serrations.

7. An eating utensil assembly comprising:

a first eating utensil comprising a first handle having a through-opening therein, said first handle and the through-opening each having a proximal end and an enlarged width distal end that is enlarged relative to the proximal end to define a first handle contour and a through-opening contour, respectively, the first handle contour matching the through-opening contour, and a first eating utensil head comprising one of a plurality of tines extending outwardly from the proximal end of said first handle, a rounded container coupled to the proximal end of said first handle, a rounded container coupled to the end of the first handle, a rounded container coupled to the proximal end of the first handle and a plurality of times extending outwardly from the proximal end of the rounded container;

a second eating utensil removably carried by said first eating utensil within the through-opening and extending a length of said first handle from the proximal and enlarged width distal ends, said second eating utensil having a proximal end of the through-opening to the enlarged width distal end of the through opening, said second eating utensil having a proximal end and enlarged width distal end that is enlarged relative to the proximal end of said second eating utensil to define a second eating utensil contour, the second eating utensil contour matching the first handle and through-opening contours, said second eating utensil being flush with an upper surface of said first handle, and comprising a second handle carried within the proximal end of the through-opening, and a second eating utensil head carried within the enlarged distal end of the through-opening and coupled to an end of said second handle and having an elongated cutting edge; and a plurality of breakaway tabs removably coupling said second eating utensil to said first eating utensil so that said second eating utensil is suspended within the through-opening with said elongated cutting edge carried within the enlarged width distal end of the through-opening;

said plurality of breakaway tabs, said first eating utensil, and said second eating utensil defining a monolithic unit.

8. The eating utensil assembly of claim 7, wherein said plurality of breakaway tabs extend inwardly from said first handle within the through-opening.

9. The eating utensil assembly of claim 7 wherein said elongated cutting edge comprises a plurality of serrations.

10. A method of making an eating utensil assembly comprising:

forming a first eating utensil comprising a first handle having a through-opening therein, and a first eating utensil head coupled to a proximal end of the first handle, the first handle being formed to have an enlarged width distal end that is enlarged relative to the proximal end thereof to define a first handle contour, and the through-opening being formed to have a proximal end and enlarged width distal end that is enlarged relative to the proximal end thereof to define a through-opening contour, the first handle contour matching the through opening contour;

forming a second eating utensil to be removably carried by the first eating utensil within the through-opening in the first handle and extending a length of the first handle from the proximal end of the through opening to the enlarged width distal end of the through-opening, the second eating utensil being formed to have a proximal end and enlarged width distal end that is enlarged relative to the proximal end of the second eating utensil to define a second eating utensil contour, the second eating utensil contour matching the first handle and through-opening contours, the second eating utensil comprising a second handle carried within the proximal end of the through-opening and a second eating utensil head carried within the proximal end of the through-opening to the second handle and having an elongated cutting edge; and forming a plurality of breakaway tabs removably coupling the second eating utensil to the first eating utensil so that the second eating utensil is suspended within the through-opening;

the plurality of breakaway tabs, the first eating utensil, and the second eating utensil being formed to be integrally molded to define a monolithic unit.

11. The method of claim 10, wherein the plurality of breakaway tabs are spaced apart between the second eating utensil and the first utensil along a perimeter of the through-opening.

12. The method of claim 10, wherein the plurality of breakaway tabs extend inwardly from the first handle within the through-opening.

13. The method of claim 10, wherein the first eating utensil head is formed to have a curved shape.

14. The method of claim 10 wherein the elongated cutting edge comprises a plurality of serrations.

* * * * *